US007258756B2

(12) United States Patent
Nagao et al.

(10) Patent No.: US 7,258,756 B2
(45) Date of Patent: Aug. 21, 2007

(54) VERY THIN, HIGH CARBON STEEL WIRE AND METHOD OF PRODUCING SAME

(75) Inventors: Mamoru Nagao, Kobe (JP); Takeshi Kuroda, Kobe (JP); Takaaki Minamida, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 503 days.

(21) Appl. No.: 10/968,253

(22) Filed: Oct. 20, 2004

(65) Prior Publication Data

US 2005/0087270 A1 Apr. 28, 2005

(30) Foreign Application Priority Data

Oct. 23, 2003 (JP) ..... 2003-363619

(51) Int. Cl.
*C21D 8/06* (2006.01)
*C22C 38/02* (2006.01)
*C22C 38/04* (2006.01)

(52) U.S. Cl. ..... 148/595; 148/599; 148/320; 148/330; 148/331; 148/332; 148/333; 148/334; 148/335; 148/336

(58) Field of Classification Search ..... 148/595, 148/598, 599, 320, 330–336
See application file for complete search history.

(56) References Cited

U.S. PATENT DOCUMENTS 5,776,267 A 7/1998 Nanba et al.
6,322,641 B1 11/2001 Makii et al.
6,645,319 B2 11/2003 Nagao et al.
6,783,609 B2 8/2004 Hata et al.
6,800,147 B2 10/2004 Nagao et al.
2004/0129354 A1 7/2004 Nagao et al.
2005/0087270 A1 4/2005 Nagao et al.

FOREIGN PATENT DOCUMENTS

EP 1 293 582 A2 3/2003
JP 6-271937 9/1994

(Continued)

OTHER PUBLICATIONS

U.S. Appl. No. 11/296,299, filed Dec. 8, 2005, Minamida et al.

(Continued)

*Primary Examiner*—Deborah Yee
(74) *Attorney, Agent, or Firm*—Oblon, Spivak, McClelland, Maier & Neustadt, P.C.

(57) ABSTRACT

The very thin, high carbon wire is 0.05 to 0.50 mm in diameter and comprises, in mass %, 0.90-1.20% of C, 0.05-1.2% of Si, 0.2-1.0% of Mn, and 0.0050% or less of N, with the balance being iron and impurities. In a differential scanning thermal analysis curve A of the steel wire, the steel wire has an exothermic peak X in the temperature range of 60° to 130° C., and a maximum height h of the exothermic peak X relative to a reference line Y joining the point of 60° C. and the point of 130° C. in the differential scanning thermal analysis curve is set at 5 μW/mg or more. The very thin, high carbon steel wire is free of delamination in high-speed stranding and superior in both strength and ductility.

6 Claims, 3 Drawing Sheets

FOREIGN PATENT DOCUMENTS

| | | |
|---|---|---|
| JP | 7-1028 | 1/1995 |
| JP | 9-99312 | 4/1997 |
| JP | 11-269607 | 10/1999 |
| JP | 2000-319757 | 11/2000 |
| JP | 2000-336459 | 12/2000 |
| JP | 2001-192772 | 7/2001 |
| JP | 2002-302736 | 10/2002 |

OTHER PUBLICATIONS

U.S. Appl. No. 10/528,263, filed Mar. 17, 2005, Nagao et al.
U.S. Appl. No. 10/968,253, filed Oct. 20, 2004, Nagao et al.
Patent Abstracts of Japan, JP 09-099312, Apr. 15, 1997.
Patent Abstracts of Japan, JP 06-158224, Jun. 7, 1994.
Patent Abstracts of Japan, JP 08-260097, Oct. 8, 1996.
Patent Abstracts of Japan, JP 08-132128, May 28, 1996.
Patent Abstracts of Japan, JP 62-284044, Dec. 9, 1987.
U.S. Appl. No 11/022,792, filed Dec. 28, 2004, Nagao.

VERY THIN, HIGH CARBON STEEL WIRE AND METHOD OF PRODUCING SAME

BACKGROUND OF THE INVENTION

1. Field of the Invention

The present invention relates to a very thin, high carbon steel wire having a high strength and superior in high-speed strandable ductility, as well as a method of producing the same.

2. Description of the Related Art

A very thin, high carbon steel wire having a diameter of 0.05 to 0.50 and a strength as high as 4200 MPa or more has come to be used as steel cord or as saw wire for cutting a semiconductor. Generally, the very thin, high carbon steel wire is produced by subjecting a steel wire rod of 4.0 to 5.5 mm in diameter which has been subjected, as necessary, to hot rolling and subsequent conditioned cooling to primary wire drawing, subsequent final patenting treatment and further wire drawing.

More particularly, the above patenting treatment involves heating the steel wire rod to a temperature range (750-1100° C.) of A3 point or higher for treatment to γ phase, subsequent quenching and allowing an isothermal transformation to proceed in the temperature range of 550-680° C., to afford a steel wire of a pearlite structure. This steel wire then goes through brass plating as a surface-layer lubricant coating treatment and is made into a very thin, high carbon steel wire by a continuous, final wet lubrication wire drawing with use of dies arranged in multiple stages.

Many of high strength, very thin, high carbon steel wires thus produced are used as stranded two- or five-ply steel cords or saw wires for cutting a semiconductor.

The very thin, high carbon steel wires applied to the aforesaid uses are required to possess such characteristics as 1) being higher in strength, 2) superior in high-speed wire drawability, 3) superior in fatigue characteristic, and 4) superior in torsional deformability (ductility) in the aforesaid stranding work.

Particularly, as the strength becomes higher than 4200 MPa, the ductility of each very thin, high carbon steel wire is deteriorated. Consequently, delamination (longitudinal cracking) becomes easier to occur during torsional deformation of the very thin, high carbon steel wire.

Anti-delamination property of the very thin, high carbon steel wire can be grasped and evaluated in advance by a phenomenon that, upon occurrence of delamination in a twisting test of the very thin, high carbon steel wire, there occurs a sudden drop of torque in a rotational angle-torque chart in the twisting test.

For enhancing the anti-delamination property of the high strength, very thin, high carbon steel wire, various techniques have heretofore been proposed with respect to the steel wire. For example, it has been proposed to control the hardness of the surface layer of the steel wire in accordance with the wire diameter and thereby prevent the occurrence of delamination (see Japanese Unexamined Patent Publication No. 2000-336459).

It has also been proposed to control the difference in tensile strength between the very thin, high carbon steel wire just after wire drawing and the very thin, high carbon steel wire after wire drawing and after subsequent age hardening to a predetermined certain range and thereby preventing the occurrence of delamination (see Japanese Unexamined Patent Publication No. 2002-302736).

Various techniques have been proposed also with respect to wire drawing. For example, there has been proposed a technique in which two separated drawing dies having different bore diameters are used and wire drawing is performed once without giving any drawing force between both drawing dies (see Japanese Unexamined Patent Publication No. Hei 7(1995)-1028).

Further, it has been proposed to effect wire drawing by raw drawing without intermediate heat treatment and setting a die approach angle at a low angle during wire drawing to optimize the reduction of area in each stage (see Japanese Unexamined Patent Publication No. 2001-192772).

However, even by the above conventional proposed techniques, delamination cannot be prevented effectively in the case of very thin, high carbon steel wires having a diameter of 0.05 to 0.50 mm and having a strength as high as 4200 MPa or more. This is presumed to be because a new delamination generating mechanism so far not found out is added in the region of those high strength, very thin, high carbon steel wires in comparison with the conventional lower strength region.

SUMMARY OF THE INVENTION

The present invention has been accomplished for solving the above-mentioned problem and it is an object of the invention to provide a very thin, high carbon steel wire having a high strength and superior in ductility, which does not undergo delamination in a high-speed stranding work, as well as a method of producing the same.

According to the present invention, for achieving the above-mentioned object, there is provided a very thin, high carbon steel wire comprising, in mass %, 0.90-1.20% of C, 0.05-1.2% of Si, 0.2-1.0% of Mn, and 0.0050% or less of N, with the balance being iron and impurities, and having a wire diameter of 0.05-0.50 mm, wherein the steel wire has an exothermic peak in a temperature range of 60° C. to 130° C. in a differential scanning thermal analysis curve thereof and a maximum height of the exothermic peak relative to a reference line joining the point of 60° C. and the point of 130° C. in the differential scanning thermal analysis curve is 5 μW/mg or more.

The steel wire may further contain, in mass %, at least one of 0.005-0.30% of Cr, 0.005-0.30% of V, 0.05-0.25% of Cu, 0.05-0.30% of Ni, 0.05-0.25% of Mo, and 0.0005-0.0050% of B.

The steel wire may further contain, in mass %, at least one of 0.10% or less of Nb (excluding 0%) and 0.010% or less of Ti (excluding 0%).

The steel wire may further contain, in mass %, 2.0% or less of Co.

The steel wire preferably has a strength of 4200 MPa or more.

Further, according to the present invention, for achieving the above-mentioned object, there is provided a method of producing a very thin, high carbon steel wire by subjecting a steel wire rod containing, in mass %, 0.90-1.20% of C, 0.05-1.2% of Si, 0.2-1.0% of Mn, and 0.0050% or less of N, to a patenting treatment in a wire diameter range of 0.50 to 2.0 mm to afford a pearlite structure, then subjecting the wire rod to a surface-layer lubricant coating treatment and subsequently to a continuous wet lubrication wire drawing with use of dies arranged in multiple stages to afford a very thin steel wire having a diameter in the range of 0.05 to 0.50 mm, characterized in that the reduction of area of each of the dies is 20% or less, the product $Di^2 \times v$, of the square of the diameter Di (mm) of each of the dies and a wire passing rate (m/min) on a die outlet side is 20 ($mm^2 \times m$)/min or less, a lubricant liquid temperature is in the range of 0° C. to 25°

C., and a skin pass wire drawing of 10% or less in terms of the reduction of area is performed after wire drawing in at least three or more stages of dies including a final wire drawing die and a die located upstream of the final wire drawing die.

Having analyzed a differential scanning thermal analysis curve of a very thin, high carbon steel wire, the present inventors found out that there was a correlation between the presence or absence of an exothermic peak near 100° C. so far not confirmed yet and the occurrence of delamination during torsional deformation of the very thin, high carbon steel wire. As will be described later, the exothermic peak near 100° C. is presumed to be an exothermic peek related to whether N atoms are fixed to dislocation or not. More particularly, it is presumed that when N atoms in the steel wire structure are not fixed to dislocation, there will occur an exothermic peak, while when the N atoms are fixed to dislocation, an exothermic peak will not occur. On the other hand, according to the knowledge of the present inventors, when an exothermic peak near 100° C. occurs, the occurrence of delamination of the very thin, high carbon steel wire can be prevented, while when such an exothermic peak does not occur, it is impossible to prevent the occurrence of delamination.

From the above points it is presumed that in the region of very thin, high carbon steel wires ranging in diameter from 0.05 to 0.50 mm and having a strength as high as 4200 MPa or more, the ductility of each steel wire will be greatly influenced by whether N atoms are fixed or not to dislocation within the steel wire structure. Therefore, it is presumed that when N atoms are not fixed to dislocation even by wet lubrication wire drawing, the ductility of the steel wire as product is improved and the occurrence of delamination can be prevented, while when N atoms are fixed to dislocation by wet lubrication wire drawing, the ductility of the steel wire as product is deteriorated and delamination becomes easier to occur.

Generally, in very thin, high carbon steel wires, an N content of 0.0050% or less is unavoidable and it is not economical in steel manufacture to make the content of N zero. Thus, it is presumed that the above-mentioned influence of N atoms on the occurrence of delamination will be unavoidable in the region of such very thin, high carbon steel wires of a high strength as described above. Also in the region of very thin, high carbon steel wires of a lower strength there will be the above-mentioned influence of N atoms on the occurrence of delamination, but it is presumed that other factors will become more influential.

In the present invention it is intended to prevent the occurrence of delamination of a very thin, high carbon steel wire during torsional deformation in a high-speed stranding work even when the steel wire substantially contains N. To this end, in the very thin, high carbon steel wire according to the present invention, the foregoing specific exothermic peak in the differential scanning thermoanalysis curve is controlled (fixing of N atoms to dislocation in the steel wire structure is made zero) to improve the ductility of the steel wire and prevent the occurrence of delamination. In the method of producing the very thin, high carbon steel wire according to the present invention, the foregoing specific exothermic peak in the differential scanning thermoanalysis curve is controlled so as to prevent the fixing of N atoms to dislocation in the steel wire structure as far as possible, thereby improving the ductility of the steel wire and preventing the occurrence of delamination.

DETAILED DESCRIPTION OF THE PREFERRED EMBODIMENT (Differential Scanning Thermoanalysis Curve)

Whether N atoms are fixed or not to dislocation in the steel wire structure, which was referred to above, is difficult to be measured or determined even by direct observation of the steel wire structure or by any other measuring method and is thus still a matter of conjecture. In the present invention, control or evaluation of ductility of the very thin, high carbon steel wire is performed by whether there is an exothermic peak or not near 100° C. in a differential scanning thermoanalysis curve (hereinafter also referred to simply as "DSC") of the very thin, high carbon steel wire. The exothermic peak is clearly correlated with the occurrence of delamination in torsional deformation and can be measured with high reproducibility.

Figure 1:
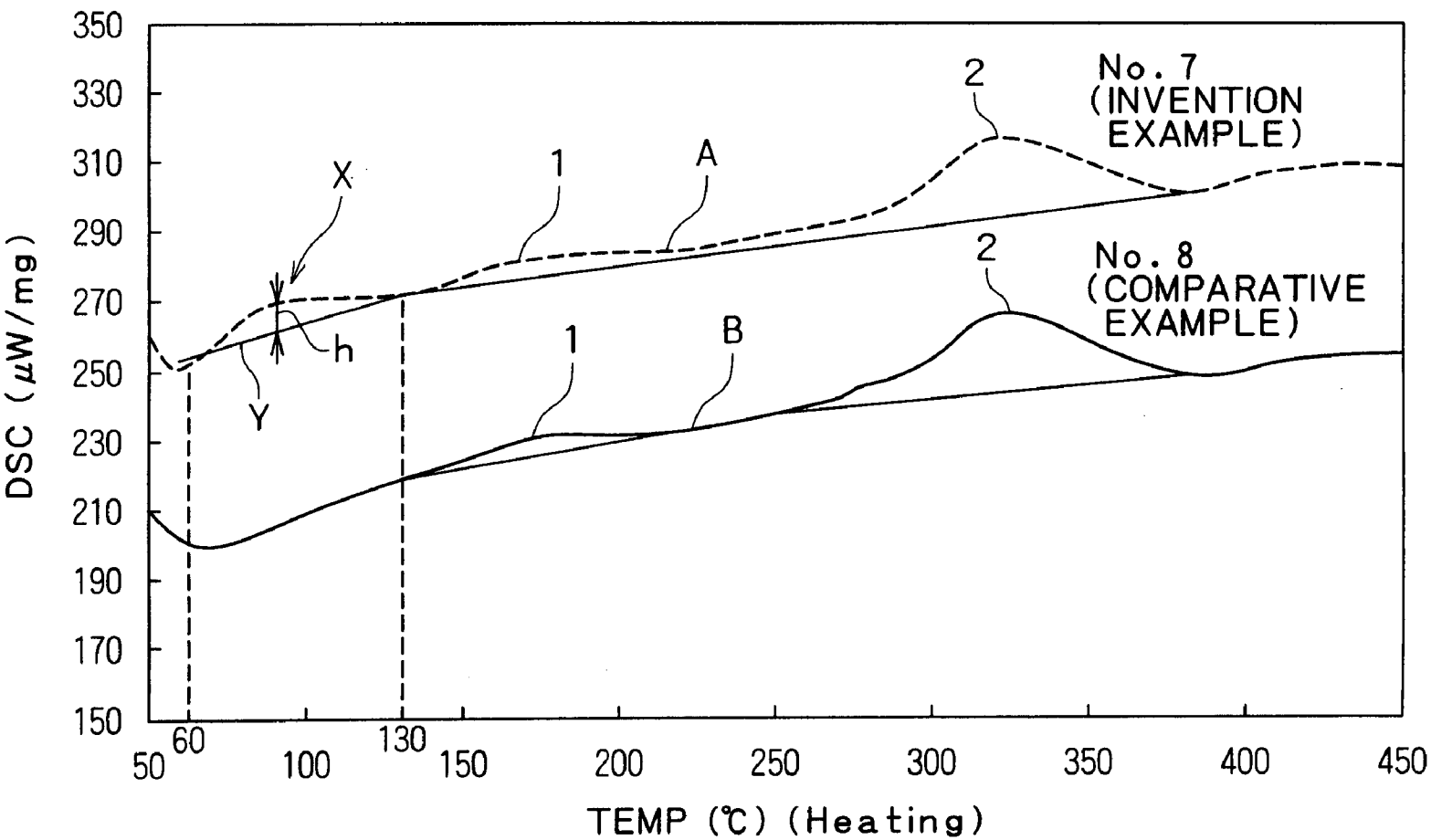
FIG. 1 is an explanatory diagram showing differential scanning thermal analysis curves of very thin, high carbon steel wires.

FIG. 1 shows differential scanning thermoanalysis curves of very thin, high carbon steel wires. In the same figure, a curve having an upward peak relative to a reference line (straight line) in DSC to be described later represents an exothermic peak, while a curve having a downward peak represents an endothermic peak. As indicated at A in FIG. 1, which is an example of DSC according to the present invention, an exothermic peak X lying in the temperature range of 60° C. to 130° C. in DSC is an exothermic peak which is clearly correlated with the occurrence of delamination during torsional deformation and which will be related to whether N atoms are fixed to dislocation or not. In the case where N atoms are not fixed to dislocation as in the DSC example of A, the exothermic peak X is presumed to be present in the temperature range of 60° C. to 130° C. in this DSC. On the other hand, in a comparative DSC example of B wherein N atoms are fixed to dislocation, the exothermic peak X is presumed to be absent in the same temperature range of 60° C. to 130° C.

In connection with other exothermic peaks in both DSCs of A and B in FIG. 1, a first exothermic peak 1 near 170° C. is presumed to be an exothermic peak which represents fixing (segregation) of C atoms to dislocation. This is presumed to indicate that cementite having gone through a wire drawing process is decomposed by thermal activity resulting from a rise of temperature and released C atoms, then the released C atoms are fixed to dislocation. Further, a second exothermic peak near 300° C. is presumed to indicate re-precipitation of cementite.

With a mere determination of whether the exothermic peak X is present or not in the temperature range of 60° C. to 130° C. in DSC, a certain DSC measurement result may be indistinct as to whether an exothermic peak appears or not and as to whether the steel wire concerned is superior in anti-delamination property or not. In the present invention, in order to make this point clearer, the case where N atoms are not fixed to dislocation is defined in terms of a maximum height h of the exothermic peak X relative to a reference line Y (straight line) joining the point of 60° C. and the point of 130° C. in the DSC. More specifically, the maximum height h is defined to be 5 μW/mg or more. If the maximum height h of the exothermic peak X is less than 5 μW/mg or if there is no exothermic peak X, it is very likely that N atoms will be fixed to dislocation. If so, the ductility of the steel wire is deteriorated and it is impossible to prevent the occurrence of delamination.

A description will now be given about DSC measuring conditions with respect to a very thin, high carbon steel wire. A test piece is sampled from a very thin, high carbon steel wire after wire drawing which is 0.05 to 0.50 mm in diameter. The test piece is placed into a DSC measuring chamber and DSC is measured in the temperature range of 0° to 500° C.

For determining whether there is an exothermic peak X or not of DSC in the temperature range of 60° to 130° C., it is necessary to surely raise the temperature of the test piece from the state of 0° C. and then start the measurement of DSC. For example, if the temperature of the test piece is raised from the state of room temperature and then the measurement of DSC is started, the measurement becomes inaccurate with respect to a low temperature portion, especially the temperature range of 60° to 130° C., and whether the exothermic peak X is present or not cannot be determined exactly in the said temperature range of 60° to 130° C.

In this connection, there are conventional examples of measuring DSC with respect to very thin, high carbon steel wires. However, in all of these examples, as noted above, the temperature of each test piece is raised from room temperature and then an actual DSC measurement is started at a temperature of about 50° to 60° C. This is because, as is seen from the DSC of FIG. 1, there is much noise or disturbance in the temperature range of not higher than 50° to 60° C. and the DSC in this temperature range does not reflect the actual state correctly. This is also the case with the DSC measurement in the present invention.

However, as mentioned above, from the result of DSC measurement not raising the temperature of a test piece from the state of 0° C. and involving inaccurate measurement of a low temperature range, especially the temperature range of 60° to 130° C., it is impossible to measure and determine the presence or absence of the exothermic peak X in the temperature range of 60° to 130° C. in the present invention. The reason why the conventional DSC measuring method could not measure or determine the presence itself of the exothermic peak X in the temperature range of 60° to 130° C. or whether the exothermic peak X was present or not is presumed to be greatly attributable to such a difference in the method for measuring DSC.

Other DSC measuring conditions will now be described. The weight of a steel wire sample was set at 20 mg. Argon gas was used as an atmosphere gas (heating medium) in a chamber and was allowed to flow through the interior of the chamber at a flow rate of 30 mL/min so as to attain a heat-up rate of 20° C./min. Further, aluminum was used as a reference and a sample container made of aluminum was used.

(Pearlite Structure)

In the present invention, a steel wire rod is subjected to a patenting treatment in a wire diameter range of 0.50 to 2.0 mm to obtain a pearlite structure. The pearlite structure is a structure (sorbite structure) with ferrite and cementite arranged in a stratified state and is obtained by eutectoid transformation when the steel wire rod is cooled from austenitic state. Obtaining such a pearlite structure is essential for ensuring high strength and ductility such as wire drawability of a steel wire rod and strandability of steel wire.

(Components of Steel Wire)

The following description is now provided about chemical components of the very thin, high carbon steel wire of the present invention and reasons for restriction to each element which are necessary or preferable for acquiring characteristics such as high strength, high-speed wire drawability, high fatigue characteristic, and high strandability, these characteristics being required in such applications as steel cords and saw wires for cutting a semiconductor.

For possessing the required characteristics referred to above, a basic chemical composition of the very thin, high carbon steel wire of the present invention comprises 0.90-1.20% of C, 0.05-1.2% of Si, 0.2-1.0% of Mn, and 0.0050% or less of N, with the balance being iron and impurities. In necessary, in addition to these components, one or more of 0.005-0.30% of Cr, 0.005-0.30% of V, 0.05-0.25% of Cu, 0.03% or less of Ni, 0.05-0.25% of Mo, and 0.0005-0.0050% of B, one or two of 0.10% or less of Nb and 0.010% or less of Ti, and 2.0% or less of Co, are further contained selectively.

(C: 0.90-1.20%)

C is an economical and effective strengthening element. As the content of C increases, the amount of work hardening in wire drawing and the strength after wiring drawing increase. The effect of decreasing the amount of ferrite is also exhibited. For allowing these effects to be exhibited to a satisfactory extent, it is necessary to obtain a high carbon steel having a C content of 0.90% or more. However, if the content of C is too high, not only a net-like proeutectoid cementite is produced at an austenite grain boundary and breaking of wire becomes easier to occur in the wire drawing work, but also the wire drawability, as well as the toughness and ductility of the very thin wire after the final wire drawing step, are deteriorated markedly and the high-speed strandability is deteriorated. Therefore, an upper limit of the C content is set at 1.20%.

(Si: 0.05-1.2%)

Si is an element necessary for deoxidation of steel and is necessary for deoxidation particularly when Al is not contained. Si is also effective in dissolving in the ferrite phase in pearlite which is formed after patenting heat treatment and in enhancing the strength after patenting. If the content of Si is less than 0.05%, the deoxidizing effect and the strength improving effect will be insufficient. In view of this point, a lower limit of Si is set at 0.05%. On the other hand, if the content of Si is too high, it becomes difficult to carry out the wire drawing process by mechanical descaling (hereinafter referred to also as "MD"); besides, the ductility of ferrite in pearlite and that of the thin wire after wire drawing are deteriorated. Therefore, an upper limit of the Si content is set at 1.2%.

(Mn: 0.2-1.0%)

Like Si, Mn is also useful as a deoxidizer. In the case of such a steel wire rod as in the present invention which does not contain Al positively, it is necessary to add not only Si but also Mn to let the above deoxidizing action be exhibited effectively. Further, Mn not only exhibits the effect of fixing S in steel as MnS and enhancing the toughness and ductility of steel but also exhibits the effect of enhancing the hardenability of steel and decreasing proeutectoid ferrite of a rolled material. If the content of Mn is less than 0.2%, no effect will be exhibited. To let the aforesaid effects be exhibited effectively, a lower limit of Mn is set at 0.2%. On the other hand, since Mn is an element easy to segregate, a higher Mn content than 1.0% will induce segregation and such supercooled structures as bainite and martensite are produced in the segregated portion of Mn at the time of patenting, which affects the subsequent wire drawability. In view of this point, an upper limit of Mn is set at 1.0%.

(N: 0.0050% or Less)

As noted earlier, N is fixed to dislocation, deteriorates the ductility of steel wire, and makes delamination easier to occur in high-speed stranding. This tendency becomes stronger if the content of N is high. Therefore, an upper limit of N is set at 0.0050% as the total amount of N, and it is preferable that the lower the content of N, the better. Generally, however, in the case of a very thin, high carbon steel wire, 0.0050% or less as the content of N is unavoidable as the total amount of N as noted above. Making the content of N zero is not impossible, but is not economical in steel manufacture. As mentioned above, moreover, the present invention intends to prevent the occurrence of delamination in high-speed stranding.

(At Least One of Cr: 0.005-0.30%, V: 0.005-0.30%, Cu: 0.05-0.25%, Ni: 0.05-0.30%, Mo: 0.05-0.25%, and B: 0.0005-0.0050%)

Cr, V, Cu, Ni, Mo, and B are equal effect elements which improve hardenability. These elements also have a common effect of suppressing the appearance of an abnormal portion of cementite, making pearlite fine, and eliminating a cementite network and thick cementite, in the structure after patenting. For allowing these effects to be exhibited, at least one of these elements is incorporated in the steel wire selectively. However, if the steel wire contains a large amount of these elements, there will occur inconveniences such as a rise of dislocation density in ferrite after heat treatment and a lowering in ductility of the ferrite phase with consequent marked deterioration in ductility of the very thin wire after drawing.

(Cr: 0.005-0.30%)

As noted above, Cr not only improves hardenability but also makes a lamellar spacing of pearlite fine and makes pearlite fine. Thus, Cr is effective in improving the strength of the very fine, high carbon steel wire and the wire drawability of the wire rod used. For allowing this effect to be exhibited effectively, Cr is contained selectively in an amount of 0.005% or more. On the other hand, if the amount of Cr is too large, undissolved cementite becomes easier to be produced, or the transformation end time becomes longer, with a consequent likelihood of formation of such a supercooled structure as martensite or bainite in the hot rolled wire rod. Besides, MD characteristic is also deteriorated. In view of these points, an upper limit of the Cr content is set at 0.03%.

(V: 0.005-0.30%)

V is effective in improving hardenability and enhancing the strength of the very thin steel wire. For allowing such a function to be exhibited effectively, 0.005% or more of V is contained selectively. On the other hand, an excessively high content of V will results in formation of carbides to excess, a decrease of the amount of C to be used as lamellar cementite, a lowering of strength, and formation of a second-phase ferrite to excess. In view of these points, an upper limit of the V content is set at 0.30%.

(Cu: 0.05-0.25%)

Cu not only exhibits the above effects but also is effective in improving the corrosion resistance of the very thin, steel wire, improving the descaling property in MD and preventing the occurrence of a trouble such as galling of dies. For allowing such a function to be exhibited effectively, 0.05% or more of Cu is contained selectively. On the other hand, if the content of Cu is too high, blister will occur on the surface of the wire rod even if the wire rod standing temperature after hot rolling is set as high as 900° C. or so, and magnetite will be produced in the steel base metal which underlies the blister, thus resulting in deterioration of MD characteristic. Further, since Cu reacts with S and segregates CuS in each grain boundary, resulting in steel ingot and wire rod being flawed in the course of manufacture of the wire rod. In view of these point, an upper limit of Cu is set at 0.25%.

(Ni: 0.05-0.30%)

Ni not only has the above effects but also improves the ductility of cementite and is therefore effective in improving the ductility such as wire drawability. A content of Ni equal to or somewhat lower than that of Cu as a countermeasure to hot cracking caused by the addition of Cu is effective in manufacture. On the other hand, Ni is expensive and therefore an upper limit of the Ni content is set at 0.30%.

(Mo: 0.05-0.25%)

Mo is effective in improving hardenability and enhancing the strength of the very thin steel wire. For effective exhibition of such a function, 0.05% or more of Mo is contained selectively. On the other hand, a too high content of Mo will result in formation of carbides to excess, a lowering of the content of C to be used as lamellar cementite, a lowering of strength, and formation of a second-phase ferrite to excess. In view of these points, an upper limit of the Mo content is set at 0.25%.

(B: 0.0005-0.0050%)

B is effective in improving hardenability and suppressing the formation of grain boundary ferrite produced in patenting. Since the grain boundary ferrite may give a starting point of generation of delamination, the incorporation of B in the steel wire can suppress delamination more positively. For effective exhibition of such a function, 0.0005% or more of B is contained selectively. On the other hand, a too high content of B will result in the amount of free B effective in exhibiting the above effect being decreased, a coarse compound becoming easier to be produced and the ductility being rather deteriorated. In view of these points, an upper limit of the B content is set at 0.0050%.

(At Least One of Nb: 0.10% or Less and Ti: 0.010% or Less)

For fixing N as NbN or TiN, it is preferable that Nb and Ti be contained selectively in an amount of 0.005% or more as a lower limit. However, if Nb and Ti are contained to excess, surplus Nb and Ti will cause NbC or TiC to be precipitated and induce precipitation and strengthening of lamellar ferrite, resulting in deterioration of wire drawability. Moreover, a too high content of Nb and Ti will result in coarsening of NbN or TiN. In view of these points, an upper limit of Nb content and that of Ti content are set at 0.1.0% and 0.010%, respectively.

(Co: 2.0% or Less)

Co suppresses the formation of proeutectoid cementite and improves the ductility and wire drawability. Therefore, Co is contained selectively in an amount of 0.005% or more as a preferred lower limit value. However, a too high content of Co will result in a longer time being required for pearlite transformation in patenting and the productivity being lowered. Therefore, an upper limit of the Co content is set at 2.0%.

(Manufacturing Method)

Next, the following description is now provided about preferred manufacturing conditions for the very thin, high carbon steel wire according to the present invention. In the present invention, a steel wire rod is subjected to wire drawing after hot rolling and subsequent patenting treatment in the wire diameter range of 0.50 to 2.0 mm to afford a pearlite structure, followed by wet lubrication wire drawing to obtain the very thin steel wire of the present invention having a diameter of 0.05 to 0.50 mm.

If the diameter of the steel wire rod to be subjected to patenting treatment is smaller than 0.50 mm, the reduction ratio in wet lubrication wire drawing cannot be taken large, so that work hardening becomes insufficient and a very thin steel wire of a high strength cannot be obtained. Moreover, if the diameter of the steel wire rod subjected to patenting treatment exceeds 2.0 mm, the wet lubrication wire drawing itself becomes difficult.

In the patenting treatment, the steel wire rod is heated to a temperature range (750-1100° C.) of A3 point or higher to effect gamma treatment, then is quenched into a lead or molten salt bath and an isothermal transformation treatment in the range of 550 to 680° C. is allowed to proceed, affording a uniform pearlite structure. In this case, in the structure after patenting, if a thin ferrite or a pseudo-pearlite structure is precipitated along old γ grain boundaries, this phase serves as a starting point of cracking in the wire drawing process, and therefore it is preferable to suppress such precipitation as far as possible or change the form of precipitation into a form difficult to cause cracking. Also in case of precipitation of a network of cementite or thick cementite, it is preferable to minimize such precipitation because the attainment of high strength and high ductility is obstructed.

After the surface-layer lubrication coating treatment applied to the pearlite-structured steel wire rod, a continuous wet lubrication wire drawing is performed using dies arranged in multiple stages to afford a very thin steel wire having a diameter of 0.05 to 0.50 mm.

Preferably, the reduction of area of each die is set at 20% or less, the product, $Di^2 \times v$, of the square of each die diameter Di and a wire passing rate v on a die outlet side is 20 ($mm^2 \times m$)/min or less, the lubricant liquid temperature is in the range of 0° to 25° C., and skin pass wire drawing at a reduction of area of 10% or less is performed after wire drawing in three or more stages of dies including a final wire drawing die and a die located upstream of the final wire drawing die.

The larger the reduction of area for each die, the more promoted the uniform deformation. However, if the reduction of area is made large with respect to all of the dies, N atoms will be diffused within the steel wire structure due to for example the generation of heat in working and become easier to be fixed to dislocation. Besides, strain ageing is accelerated. Therefore, it is preferable that the reduction of area in each die be set at 20% or less in the whole stage including an initial wire drawing stage wherein the ductility is not influenced even if wire drawing is performed at a relatively large reduction of area and a latter stage wherein the ductility is greatly influenced by strain ageing for example.

The wire passing rate in each die also exerts an influence on the diffusion and fixing to dislocation of N atoms due to for example the generation of heat in working. The wire passing rate exerts an influence also on strain aging. If the wire passing rate is set high, the diffusion and fixing to dislocation of N atoms, as well as strain ageing, will be accelerated. As to the wire passing rate in each die, therefore, it is preferable that the product, $Di^2 \times v$, of the square of each die diameter Di and the wire passing rate v on a die outlet side be set at 20 ($mm^2 \times m$)/min or less, in relation to the diameter of each die and including both initial and latter stages of wire drawing.

A high lubricant liquid temperature affects the diffusion and fixing to dislocation of N atoms caused by the generation of heat in working for example. Therefore, the lubricant liquid temperature during wire drawing is set at 25° C. or lower. On the other hand, it is not necessary to set the lubricant liquid temperature as low as below 0° C. at which a new problem such as embrittlement of the steel wire might arise. Thus, it is preferable to set the lubricant liquid temperature in the range of 0° to 25° C.

In the present invention, in order to let the foregoing exothermic peak be present in DSC of the steel wire after wire drawing and making a maximum height of the exothermic peak a predetermined height or higher to improve the ductility of the steel wire, it is more preferable to further perform a skin pass wire drawing in a latter stage of steel wire drawing, in addition to the above conditions of wet lubrication wire drawing.

It is preferable that the skin pass wire drawing be carried out at a reduction of area of 10% or less after wire drawing in three or more stages of dies including a final wire drawing die and a die located upstream of the final wire drawing die. More specifically, skin pass wire drawing dies are disposed behind and near the above there or more stages of wire drawing dies, and wire drawing and skin pass wire drawing are performed in this state.

If this skin pass wire drawing is performed under conditions not conforming to the above conditions defined in the present invention, for example if skin pass wire drawing is not performed after wire drawing by the final wire drawing die, if the number of dies used is two stages of dies including a final wire drawing die and a die located upstream of the final wire drawing die, or if the reduction of area in any skin pass wire drawing exceeds 10%, the effect of skin pass wire drawing will not be exhibited. In these cases, the foregoing exothermic peak will not appear in DSC of the steel wire after wire drawing, or even if there appears the exothermic peak, it is very likely that it will become impossible to set the maximum height of the exothermic peak at a predetermined height or higher. As a result, the ductility of the steel wire is deteriorated and it becomes impossible to prevent the occurrence of delamination.

Skin pass wire drawing dies are disposed behind and in proximity to the above three or more stages of wire drawing dies and skin pass wire drawing is performed just after the wire drawing using the wire drawing dies.

Figure 2:
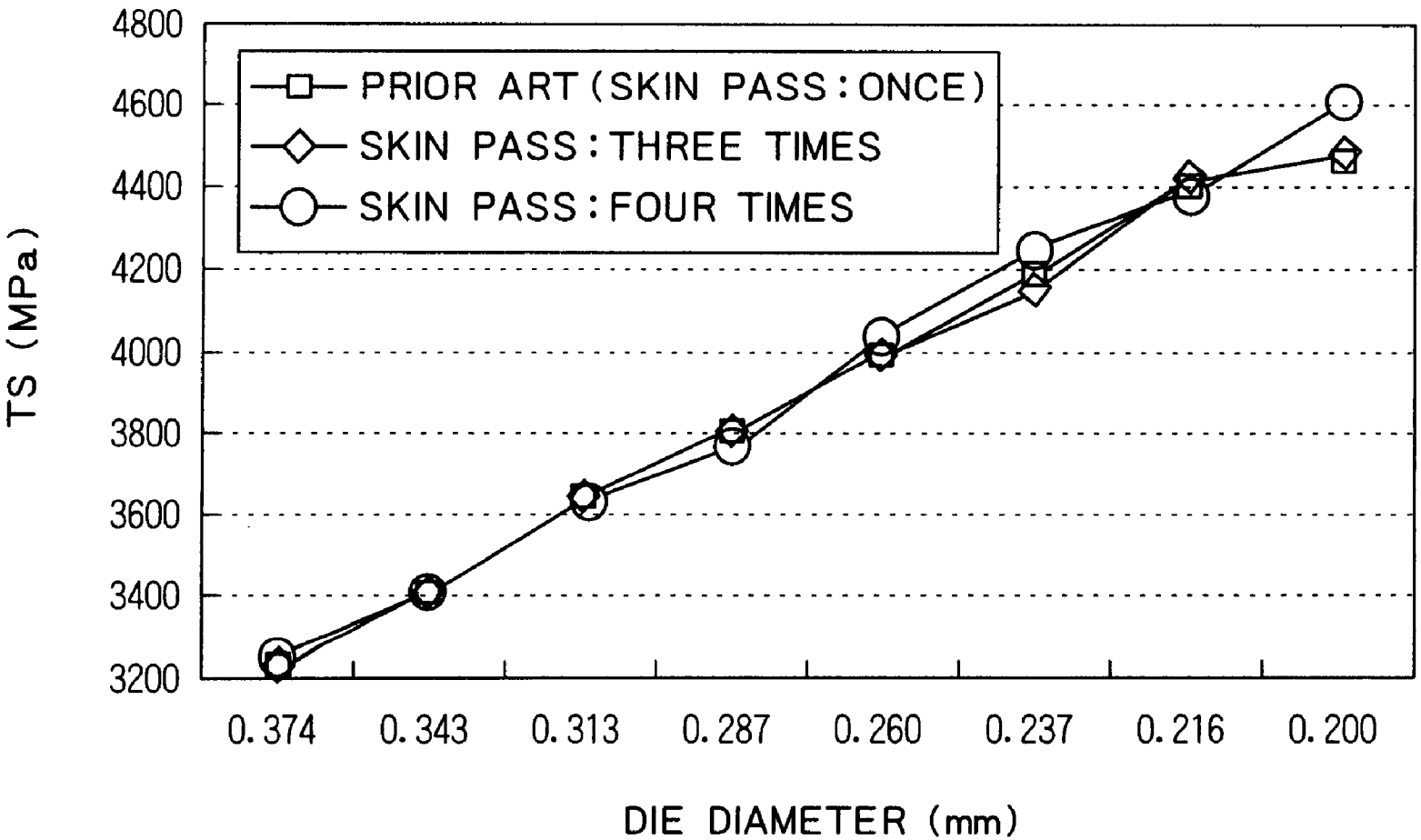
FIG. 2 is an explanatory diagram showing work hardening quantities in steel wires of various final wire diameters in wet lubrication wire drawing conducted up to the various final wire diameters.
Figure 3:
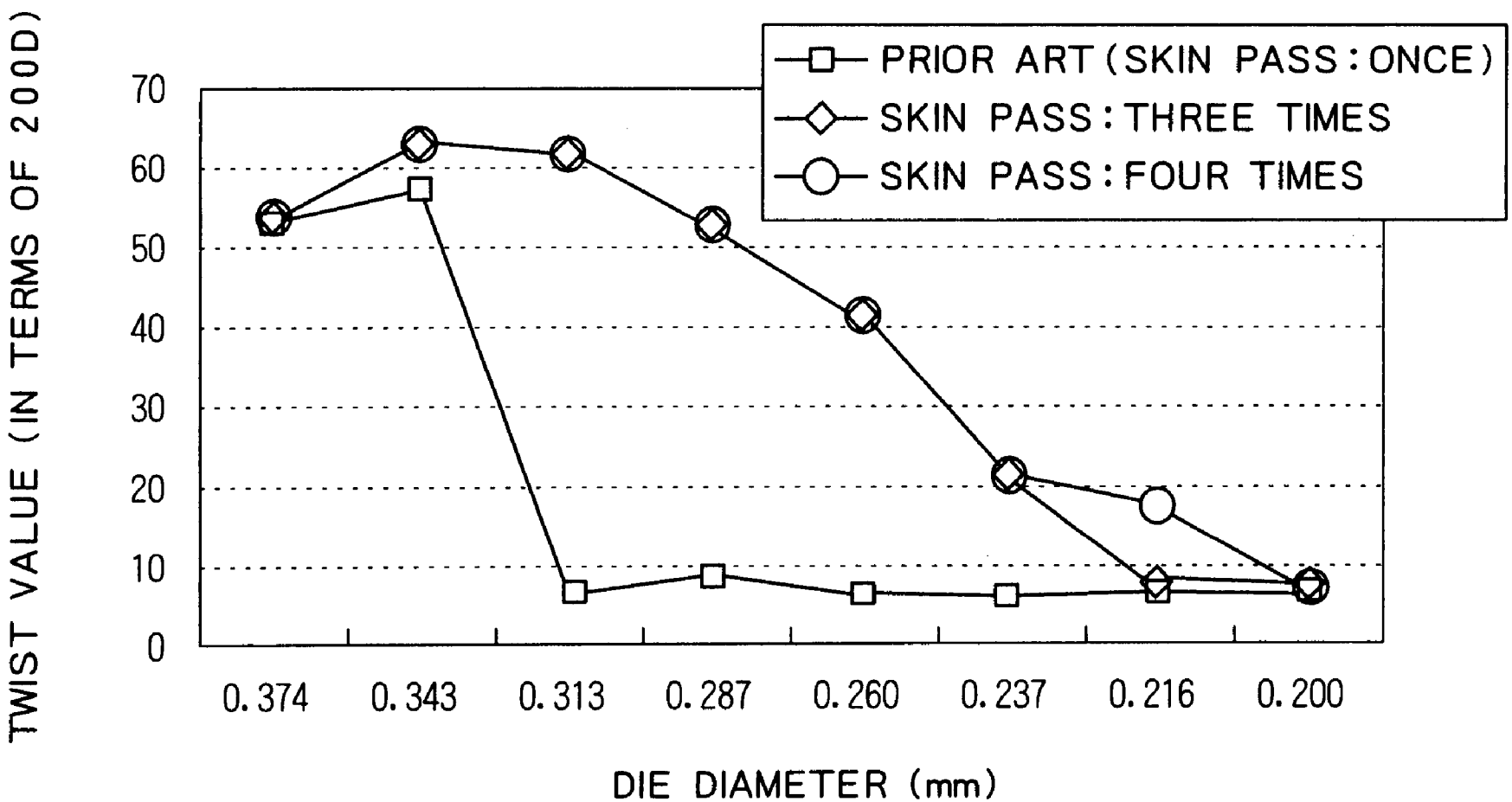
FIG. 3 is an explanatory diagram showing twist values in steel wires of various final wire diameters in wet lubrication wire drawing conducted up to the various wire diameters.

FIGS. 2 and 3 show changes in strength of steel wires at final wire diameters in case of wet lubrication wire drawing having been performed continuously using one, three and four stages of dies at various fine wire diameters of 0.374 to 0.200 mm in a lubricant liquid, as well as twist values (in terms of 200D, unit: the number of times) in a twisting test. FIG. 2 shows strength change quantities and FIG. 3 shows twist values in the twisting test.

In FIGS. 2 and 3, circular marks represent a comparative example in which skin pass wire drawing was performed in only the final stage, rhombic marks represent an example according to the present invention in which skin pass wire drawing was performed in three stages including the final wire drawing die and two upstream stages of dies, and square marks represent an example according to the present invention in which skin pass wire drawing was performed in four stages including the final wire drawing die and three upstream stages of dies.

The test in FIGS. 2 and 3 was conducted in the following manner. A steel wire rod having a composition defined in the present invention and a diameter of 5.5 mm was subjected to a primary wire drawing work into a diameter of 1.65 m, then was subjected to patenting treatment to afford a uniform pearlite structure, then to brass plating, and further to wet lubrication wire drawing continuously up to the above fine wire diameters within the foregoing ranges of preferred conditions.

As is seen from FIG. 2, in all of the test examples, the larger the reduction of area in wet lubrication wire drawing (the thinner the final wire diameter), the larger the work hardening quantity. In this point there is no significant difference among the test examples.

On the other hand, as in FIG. 3, as to the twist value in the twisting test, i.e., delamination characteristic, there is a significant difference in behavior between the comparative examples and the examples of the present invention. In the comparative example (square marks), the twist value lowers to ten times or less in an early stage of the final wire diameter of 0.313 mm. On the other hand, in the example (rhombic mark) of the present invention involving three stages of skin pass wire drawing, the twist value does not drop to ten times or less up to a steel wire having a smaller diameter of 0.200 mm, and likewise in the example (circular marks) of the present invention involving four stages of skin pass wire drawing, the twist value does not drop to ten times or less up to a steel wire having a smaller diameter of 0.216 mm. Thus, the delamination characteristic improving effect of skin pass wire drawing under the above specific conditions according to the present invention is supported.

EXAMPLE 1

Working examples of the present invention will be described below. As Example 1, very thin steel wires were produced while changing the above wet lubrication wire drawing conditions variously to afford very thin steel wires, then the presence or absence of the foregoing exothermic peak X in DSC of each of the very thin steels wires, the maximum height h of the exothermic peak, and delamination characteristic, were evaluated.

More specifically, high carbon steel billets of compositions A to X in Table 1 below were subjected to hot rolling to produce steel wire rods, then the steel wire rods were subjected to wire drawing and patenting treatment under the wire diameter and strength conditions shown in Table 2 below to obtain a pearlite structure, followed by wet lubrication wire drawing to afford very thin steel wires.

In both examples according to the present invention and comparative examples, patenting treatment was conducted in the following manner. Heating was made to a temperature range (950-1000° C.) of A3 point or higher to effect gamma treatment, followed by quenching in a molten lead bath, and an isothermal transformation treatment was allowed to proceed at a temperature of 560° to 585° C., affording a uniform pearlite structure.

The thus pearlite-structurized steel wire rods were subjected to Cu—Zn diffusion plating as a surface-layer lubrication coating treatment and thereafter baked at a temperature of 180° C. as a dehydrogenation treatment. Subsequently, the wire rods were subjected to a continuous wet lubrication wire drawing using dies arranged in 25 stages while being dipped in a lubricant liquid to obtain very thin steel wires having such product wire diameters as shown in Table 2. In the wet lubrication wire drawing, the reduction of area in each die, wire passing rate ($Di^2 \times v$), lubricant liquid temperature, and skin pass wire drawing conditions, were changed variously. These various wet lubrication wire drawing conditions are set forth in Table 2. The reduction of area in case of performing skin pass wire drawing was set at 3% to 4% in each example and in each stage.

With respect to the steel wires thus subjected to wet lubrication wire drawing, the wire diameter just after the wire drawing, strength, the presence or absence of the exothermic peak X in the temperature range of 60° to 130° C. in DSC, the maximum height h (μW/mg) of the exothermic height X relative to the reference line Y joining the point of 60° C. and the point of 130° C. in the DSC, and delamination characteristics, were evaluated. Measurement of the exothermic peak X was conducted in the manner described above. As a DSC measuring apparatus there was used DSC 220 (a product of Seiko Instruments Co.).

Delamination characteristic was evaluated in terms of a twist value (the number of twists) until the occurrence of a sudden drop of torque in a chart of both rotational angle and torque in a twist test for a test piece of a steel wire after wire drawing. The evaluation was made such that test pieces of ten times or more as twist values were ○ and those of less than ten times as twist values were X.

As is apparent from Tables 1 and 2, very thin, high carbon steel wires of Examples 1, 3, 5, 7, 9, 12, 14, and 16 according to the present invention comprise chemical compositions A, B, E, F, J, K, M, and N, respectively, which fall under the scope of the present invention, and also as to the reduction of area in each die, wire passing rate ($Di^2 \times v$), lubricant liquid temperature, and skin pass wire drawing conditions, in wet lubrication wire drawing, are within the respective preferred ranges. Thus, the very thin, high carbon steel wires are as high as 4200 MPa or more in strength, have exothermic peaks X in the temperature range of 60° to 130° C. in DSC, maximum heights of the exothermic peaks X of 5 μW/mg or more. From these results it is seen that the steel wires in question are superior in delamination characteristics and also in ductility.

On the other hand, the steel wires of Comparative Examples 2, 4, 6, 8, 10, 11, 13, 15, and 17 have chemical compositions falling under the scope of the present invention, but as to the reduction of area in each die, wire passing rate ($Di^2 \times v$), lubricant liquid temperature, and skin pass wire drawing conditions, in wet lubrication wire drawing, any of these conditions are outside their preferred ranges. Although high strengths of 4200 MPa or more are obtained, but there is no exothermic peak X in the temperature range of 60° to 130° C. in DSC, or even if there is an exothermic peak X, the maximum height h thereof is less than 5 μW/mg. Thus, the Comparative Examples are markedly inferior in delamination characteristic to the Examples of the present invention.

For example, in Comparative Example 2, the reduction of area in each die exceeds 20%. In Comparative Example 4, the wire passing rate ($Di^2 \times v$) exceeds 20 ($mm^2 \times m$)/min. In Comparative Example 6, the lubricant liquid temperature exceeds 25° C. In Comparative Examples 8, 10, 11, 13, 15, and 17, the number of times of skin pass wire drawing, including the final wire drawing die and the die located upstream thereof is two stages (times) or less.

From the above results, a critical meaning of the conditions for DSC defined in the present invention relative to the delamination characteristic can be seen. It is also possible to grasp the meaning of each of such preferred conditions as the reduction of area in each die, wire passing rate ($Di^2 \times v$), lubricant liquid temperature, and skin pass wire drawing, in wet lubrication wire drawing, which conditions are for obtaining very thin, high carbon steel wires superior in delamination characteristic.

TABLE 1

| No. | Chemical Components of Steel (mass %, the balance Fe and impurities) | | | | | | | | | | | | | | | | Remarks |
|---|---|---|---|---|---|---|---|---|---|---|---|---|---|---|---|---|---|
| | C | Si | Mn | P | S | N | Cr | V | Cu | Ni | Mo | Nb | Ti | Co | Al | B | |
| A | 0.90 | 0.15 | 0.35 | 0.006 | 0.005 | 0.0020 | — | — | — | — | — | — | — | — | 0.002 | — | Invention Examples |
| B | 0.92 | 0.18 | 0.42 | 0.007 | 0.007 | 0.0021 | 0.10 | 0.01 | — | — | — | — | — | — | 0.001 | — | |
| C | 0.96 | 0.20 | 0.44 | 0.006 | 0.008 | 0.0014 | — | — | — | — | — | — | — | — | 0.001 | — | |
| D | 1.00 | 0.21 | 0.52 | 0.004 | 0.012 | 0.0021 | — | — | — | — | — | — | — | — | 0.003 | — | |
| E | 1.20 | 0.26 | 0.21 | 0.007 | 0.008 | 0.0035 | — | — | — | — | — | — | 0.003 | — | 0.002 | — | |
| F | 1.02 | 1.19 | 0.38 | 0.007 | 0.008 | 0.0050 | 0.15 | — | — | — | — | — | — | — | 0.002 | — | |
| G | 0.92 | 0.14 | 0.44 | 0.007 | 0.010 | 0.0011 | — | 0.02 | — | — | — | — | — | — | 0.002 | — | |
| H | 0.97 | 0.22 | 0.35 | 0.003 | 0.008 | 0.0012 | — | — | 0.06 | — | — | — | — | — | 0.004 | — | |
| I | 0.96 | 0.23 | 0.36 | 0.004 | 0.007 | 0.0020 | — | — | — | 0.11 | — | — | — | — | 0.003 | — | |
| J | 1.05 | 0.19 | 0.44 | 0.004 | 0.004 | 0.0018 | — | — | — | — | 0.05 | — | — | — | 0.002 | — | |
| K | 1.08 | 0.20 | 0.40 | 0.010 | 0.005 | 0.0034 | — | — | — | — | — | 0.01 | — | — | 0.001 | — | |
| L | 1.20 | 0.20 | 0.38 | 0.003 | 0.005 | 0.0021 | — | — | — | — | — | — | — | — | 0.003 | — | |
| M | 0.99 | 0.21 | 0.48 | 0.008 | 0.010 | 0.0030 | — | — | — | — | — | — | — | 1.50 | 0.002 | — | |
| N | 1.00 | 0.19 | 0.41 | 0.005 | 0.004 | 0.0035 | 0.28 | — | — | — | — | — | — | — | 0.001 | 0.0022 | |
| O | 1.22 | 1.00 | 0.39 | 0.006 | 0.007 | 0.0056 | 0.21 | — | 0.04 | 0.08 | — | — | — | — | 0.002 | — | Comparative Examples |
| P | 0.92 | 1.23 | 0.41 | 0.007 | 0.006 | 0.0022 | — | — | — | — | — | — | | — | 0.003 | — | |
| Q | 0.95 | 0.80 | 0.77 | 0.007 | 0.010 | 0.0021 | 0.33 | 0.08 | — | — | — | — | | — | 0.02 | — | |
| R | 1.00 | 0.22 | 0.40 | 0.008 | 0.003 | 0.0045 | — | 0.31 | — | — | — | — | | — | 0.003 | — | |
| S | 1.10 | 0.21 | 0.44 | 0.004 | 0.005 | 0.0022 | — | — | 0.26 | — | — | — | | — | 0.004 | — | |
| T | 1.11 | 0.22 | 0.42 | 0.004 | 0.006 | 0.0021 | — | — | — | 0.33 | — | — | | — | 0.001 | — | |
| U | 0.97 | 0.21 | 0.44 | 0.007 | 0.009 | 0.0022 | — | — | — | — | 0.26 | — | — | — | 0.002 | — | |
| V | 0.99 | 0.18 | 0.39 | 0.008 | 0.006 | 0.0025 | — | — | — | — | — | 0.11 | — | — | 0.001 | — | |
| W | 0.90 | 0.17 | 0.35 | 0.008 | 0.009 | 0.0020 | — | — | — | — | — | — | 0.011 | — | 0.002 | — | |
| X | 1.12 | 0.20 | 0.39 | 0.008 | 0.008 | 0.0044 | — | — | — | — | — | — | | 2.1 | 0.003 | — | |

TABLE 2

| No. | Steel Type | A-mount of C (%) | Patenting | | Wet Lubrication Wire Drawing | | | | | Final (Product) Steel Wire | | | | | Remarks |
|---|---|---|---|---|---|---|---|---|---|---|---|---|---|---|---|
| | | | Wire Rod Dia. (mm) | Wire Rod Strength (MPa) | Work Strain | Reduction of Area in Each Die | Wire Passing Rate $D^2v$ ($mm^2m$/min) | Lubricant Liquid Temp. (° C.) | Skin Pass Number (time) | Wire Dia. (mm) | Strength (MPa) | DSC 60–130° C. Peak | DSC Peak × Height h μW/mg | Delamination Characteristic | |
| 1 | A | 0.90 | 0.50 | 1439 | 4.61 | 20 | 20 | 15 | 5 | 0.05 | 4400 | Yes | 5 | ○ | Invention Example |
| 2 | A | 0.90 | 0.50 | 1439 | 4.61 | 22 | 20 | 15 | 5 | 0.05 | 4440 | No | 0 | X | Comparative Example |
| 3 | B | 0.92 | 1.60 | 1549 | 4.16 | 20 | 18 | 10 | 5 | 0.20 | 4664 | Yes | 6 | ○ | Invention Example |
| 4 | B | 0.92 | 1.60 | 1549 | 4.16 | 20 | 25 | 10 | 5 | 0.20 | 4720 | No | 0 | X | Comparative Example |
| 5 | E | 1.20 | 1.50 | 1662 | 4.03 | 18 | 20 | 0 | 4 | 0.20 | 4615 | Yes | 5 | ○ | Invention Example |
| 6 | E | 1.20 | 1.50 | 1662 | 4.03 | 18 | 20 | 35 | 4 | 0.20 | 4690 | No | 0 | X | Comparative Example |
| 7 | F | 1.02 | 1.63 | 1530 | 3.83 | 18 | 20 | 7 | 3 | 0.24 | 4245 | Yes | 6 | ○ | Invention Example |
| 8 | F | 1.02 | 1.63 | 1530 | 3.83 | 18 | 20 | 50 | 1 | 0.24 | 4251 | Yes | 1 | X | Comparative Example |
| 9 | J | 1.05 | 1.55 | 1611 | 4.10 | 20 | 20 | 15 | 3 | 0.20 | 4645 | Yes | 5 | ○ | Invention Example |
| 10 | J | 1.05 | 1.55 | 1611 | 4.10 | 20 | 20 | 15 | 2 | 0.20 | 4645 | Yes | 3 | X | Comparative Example |
| 11 | J | 1.05 | 1.55 | 1611 | 4.10 | 20 | 20 | 15 | 1 | 0.20 | 4645 | No | 0 | X | Comparative Example |
| 12 | K | 1.08 | 2.25 | 1570 | 3.90 | 20 | 20 | 10 | 3 | 0.32 | 4367 | Yes | 6 | ○ | Invention Example |
| 13 | K | 1.08 | 2.25 | 1570 | 3.90 | 20 | 20 | 40 | 3 | 0.32 | 4367 | No | 0 | X | Comparative Example |
| 14 | M | 0.99 | 1.25 | 1565 | 4.24 | 18 | 15 | 7 | 3 | 0.15 | 4784 | Yes | 6 | ○ | Invention Example |
| 15 | M | 0.99 | 1.25 | 1565 | 4.24 | 18 | 15 | 7 | 1 | 0.15 | 4784 | Yes | 1 | X | Comparative Example |
| 16 | N | 1.00 | 1.63 | 1410 | 4.20 | 18 | 20 | 7 | 4 | 0.20 | 4511 | Yes | 6 | ○ | Invention Example |
| 17 | N | 1.00 | 1.63 | 1410 | 4.20 | 18 | 20 | 7 | 1 | 0.20 | 4560 | No | 0 | X | Comparative Example |

EXAMPLE 2

Next, high carbon steel wire rods of the compositions A to X shown in Table 1 were subjected to the same treatment as in Example 1 and then to wet lubrication wire drawing in the same way as in Example 1 while setting the reduction of area in each die, wire passing rate ($Di^2 \times v$), lubricant liquid temperature, and skin pass wire drawing conditions, within the respective preferred ranges. Then, the wire drawability of very thin steel wires after the wet lubrication wire drawing, the presence or absence of the exothermic peak X in DSC with respect to the very thin steel wires, the maximum height h of the exothermic peak X, and delamination characteristic, were evaluated in the same manner as in Example 1, the results of which are set forth in Table 3.

As is apparent from Table 3, very thin, high carbon steel wires of Examples 18 to 30 according to the present invention comprise chemical components A to M, respectively, which fall under the scope of the present invention, and their wire drawability in wet lubrication wire drawing is superior to that in Comparative Examples. Further, the reduction of area in each die, wire passing rate ($Di^2 \times v$), lubricant liquid temperature, and skin pass wire drawing conditions, in wet lubrication wire drawing, are all within the respective preferred ranges. Thus, it is seen that the very thin, high carbon steel wires are as high as 4200 MPa or more in strength and have exothermic peaks X in the temperature range of 60° to 130° C. in DSC and maximum heights h of the exothermic peaks X of 5 μW/mg or more. From these results it is seen that the steel wires in question are superior in delamination characteristic and also in ductility.

On the other hand, Comparative Examples 31 to 40 were inferior in wire drawability in wet lubrication wire drawing and could not be subjected to wire drawing up to final very thin, high carbon steel wires. Therefore, the measurement of strength of final very thin, high carbon steel wires, that of the exothermic peak X in DSC, and the evaluation of delamination characteristic, could not be conducted. More particularly, as to the steel type O of Comparative Example 31, there occurred embrittlement due to a too high content of nitrogen and frequent wire breaking in wet lubrication wire drawing. AS to the steel type P of Comparative Example 32, there occurred embrittlement due to a too high content of Si and frequent wire breaking in wet lubrication wire drawing. As to the steel type Q of Comparative Example 33, there occurred embrittlement due to a too high content of Cr and frequent wire breaking in wet lubrication wire drawing. As to the steel type R of Comparative Example 34, there occurred embrittlement due to a too high content of V and frequent wire breaking in wet lubrication wire drawing. As to the steel type S of Comparative Example 35, there occurred embrittlement due to a too high content of Cu and frequent wire breaking in wet lubrication wire drawing. As to the steel type T of Comparative Example 36, there occurred embrittlement due to a too high content of Ni and frequent breaking of wire in wet lubrication wire drawing. As to the steel type U of Comparative Example 37, there occurred a supercooled structure due to a too high content of Mo and frequent wire breaking in wet lubrication wire drawing. As to the steel type V of Comparative Example 38, there occurred embrittlement due to a too high content of Nb and frequent wire breaking in wet lubrication wire drawing. As to the steel type W of Comparative Example 39, there occurred embrittlement due to a too high content of Ti and frequent wire breaking in wet lubrication wire drawing. As to the steel type X of Comparative Example 40, there occurred embrittlement due to a too high content of Co and frequent breaking of wire in wet lubrication wire drawing.

From the above results it is seen that the chemical component conditions according to the present invention have a critical meaning in wet lubrication wire drawing. Further, in the wet lubrication wire drawing for obtaining very thin, high carbon steel wires superior in delamination characteristic, the meaning of each of such preferred conditions as the reduction of area in each die, wire passing rate ($Di^2 \times v$), lubricant liquid temperature, and skin pass wire drawing, can also been seen from the above results.

TABLE 3

| | | Patenting | | Wet Lubrication Wire Drawing | | | | | Final (Product) Steel Wire | | | | | |
|---|---|---|---|---|---|---|---|---|---|---|---|---|---|---|
| No. | Steel Type | Wire Rod Dia. (mm) | Wire Rod Strength (Mpa) | Work Strain | Reduction of Area in Each Die | Wire Passing Rate $D^2V$ ($mm^2m/min$) | Lubricant Liquid Temp. (° C.) | Skin Pass Number (time) | Wire Dia. (mm) | Strenth (Mpa) | DSC 60–130° C. Peak | DSC Peak × Height h μW/mg | Delamination Characteristic | Remarks |
| 18 | A | 1.58 | 1439 | 4.13 | 20 | 20 | 15 | 5 | 0.2 | 4521 | Yes | 6 | ○ | Invention |
| 19 | B | 1.50 | 1549 | 4.03 | 20 | 20 | 10 | 5 | 0.2 | 4503 | Yes | 7 | ○ | Examples |
| 20 | C | 1.51 | 1546 | 4.04 | 20 | 20 | 5 | 5 | 0.2 | 4515 | Yes | 6 | ○ | |
| 21 | D | 1.50 | 1557 | 4.03 | 18 | 20 | 0 | 5 | 0.2 | 4510 | Yes | 5 | ○ | |
| 22 | E | 1.44 | 1662 | 3.95 | 18 | 20 | 15 | 4 | 0.2 | 4516 | Yes | 5 | ○ | |
| 23 | F | 1.41 | 1708 | 3.91 | 18 | 20 | 10 | 4 | 0.2 | 4512 | Yes | 6 | ○ | |
| 24 | G | 1.55 | 1474 | 4.10 | 18 | 20 | 5 | 4 | 0.2 | 4508 | Yes | 7 | ○ | |
| 25 | H | 1.51 | 1546 | 4.04 | 20 | 20 | 0 | 4 | 0.2 | 4515 | Yes | 5 | ○ | |
| 26 | I | 1.53 | 1510 | 4.07 | 20 | 20 | 15 | 3 | 0.2 | 4512 | Yes | 6 | ○ | |
| 27 | J | 1.48 | 1611 | 4.00 | 20 | 20 | 10 | 3 | 0.2 | 4531 | Yes | 6 | ○ | |
| 28 | K | 1.42 | 1693 | 3.92 | 20 | 20 | 5 | 3 | 0.2 | 4513 | Yes | 5 | ○ | |
| 29 | L | 1.41 | 1700 | 3.91 | 18 | 20 | 0 | 3 | 0.2 | 4504 | Yes | 5 | ○ | |
| 30 | M | 1.50 | 1565 | 4.03 | 18 | 15 | 7 | 3 | 0.2 | 4518 | Yes | 6 | ○ | |
| 31 | O | 1.38 | 1763 | 4.24 | 18 | 20 | 7 | 3 | — | — | — | — | — | Compa- |
| 32 | P | 1.55 | 1505 | 4.24 | 20 | 20 | 15 | 5 | — | — | — | — | — | rative |
| 33 | Q | 1.40 | 1698 | 4.24 | 20 | 20 | 10 | 5 | — | — | — | — | — | Example |
| 34 | R | 1.45 | 1654 | 4.24 | 20 | 20 | 5 | 5 | — | — | — | — | — | |
| 35 | S | 1.52 | 1640 | 4.24 | 18 | 20 | 0 | 5 | — | — | — | — | — | |
| 36 | T | 1.44 | 1640 | 4.24 | 18 | 20 | 15 | 5 | — | — | — | — | — | |
| 37 | U | 1.45 | 1569 | 4.24 | 18 | 20 | 10 | 5 | — | — | — | — | — | |

TABLE 3-continued

| | | Patenting | | Wet Lubrication Wire Drawing | | | | | Final (Product) Steel Wire | | | | | |
|---|---|---|---|---|---|---|---|---|---|---|---|---|---|---|
| No. | Steel Type | Wire Rod Dia. (mm) | Wire Rod Strength (Mpa) | Work Strain | Reduction of Area in Each Die | Wire Passing Rate $D^2V$ ($mm^2m/min$) | Lubricant Liquid Temp. (° C.) | Skin Pass Number (time) | Wire Dia. (mm) | Strenth (Mpa) | DSC 60–130° C. Peak | DSC Peak × Height h μW/mg | Delamination Characteristic | Remarks |
| 38 | V | 1.45 | 1518 | 4.24 | 20 | 20 | 5 | 5 | — | — | — | — | — | |
| 39 | W | 1.51 | 1463 | 4.24 | 20 | 20 | 0 | 5 | — | — | — | — | — | |
| 40 | X | 1.52 | 1643 | 4.24 | 20 | 20 | 15 | 5 | — | — | — | — | — | |

According to the present invention, as described above, it is possible to provide a very thin, high carbon steel wire free of delamination in high-speed stranding and superior in strength and ductility, as well as a method of producing the same. Consequently, the very thin, high carbon steel wire can be applied stably to such uses as steel cord and saw wire for cutting a semiconductor.

What is claimed is:

1. A very thin, high carbon steel wire superior in ductility, comprising, in mass %:

0.90-1.20% of C;

0.05-1.2% of Si; 0.2-1.0% of Mn;

and 0.0050% or less of N, with the balance being iron and impurities, said steel wire having a wire diameter of 0.05-0.50 mm, wherein said steel wire has an exothermic peak in a temperature range of 60° C. to 130° C. in a differential scanning thermal analysis curve thereof and a maximum height of said exothermic peak relative to a reference line joining the point of 60° C. and the point of 130° C. in said differential scanning thermal analysis curve is 5 μW/mg or more.

2. The very thin, high carbon steel wire according to claim 1, further comprising, in mass %, at least one of 0.005-0.30% of Cr, 0.005-0.30% of V, 0.05-0.25% of Cu, 0.05-0.30% of Ni, 0.05-0.25% of Mo, and 0.0005-0.0050% of B.

3. The very thin, high carbon steel wire according to claim 1, further comprising, in mass %, at least one of 0.10% or less of Nb (excluding 0%) and 0.010% or less of Ti (excluding 0%).

4. The very thin, high carbon steel wire according to claim 1, further comprising, in mass %, 2.0% or less of Co.

5. The very thin, high carbon steel wire according to claim 1, wherein said steel wire has a strength of 4200 MPa or more.

6. A method of producing a very thin, high carbon steel wire according to claim 1, comprising the steps of:

subjecting a steel wire rod comprising, in mass %, 0.90-1.20% of C, 0.05-1.2% of Si, 0.2-1.0% of Mn, and 0.0050% or less of N, with the balance being iron and impurities, to a patenting treatment in a wire diameter range of 0.50 to 2.0 mm to afford a pearlite structure;

subjecting the patented wire rod to a surface-layer lubricant coating treatment; and subjecting the wire rod coated with the surface-layer lubricant, to a continuous wet lubrication wire drawing with use of dies arranged in multiple stages to afford a very thin steel wire having a diameter in the range of 0.05 to 0.50 mm, wherein the reduction of area of each of the dies is 20% or less, the product, $Di^2 \times v$, of the square of the diameter Di (mm) of each of the dies and a wire passing rate (m/min) on a die outlet side is 20 ($mm^2 \times m$)/min or less, a lubricant liquid temperature is in the range of 0° to 25° C., and a skin pass wire drawing of 10% or less in terms of the reduction of area is performed after wire drawing in at least three stages of dies including a final wire drawing die and a die located upstream of the final drawing die.

* * * * *

UNITED STATES PATENT AND TRADEMARK OFFICE

CERTIFICATE OF CORRECTION

PATENT NO. : 7,258,756 B2
APPLICATION NO. : 10/968253
DATED : August 21, 2007
INVENTOR(S) : Nagao et al.

It is certified that error appears in the above-identified patent and that said Letters Patent is hereby corrected as shown below:

On the title page, Item (73), the Assignee should read:

-- (73) Assignee: Kabushiki Kaisha Kobe Seiko Sho (Kobe Steel, Ltd.), Kobe-Shi (JP) --

Signed and Sealed this

Sixth Day of November, 2007

JON W. DUDAS
*Director of the United States Patent and Trademark Office*